US008962153B2

(12) United States Patent
Koumura et al.

(10) Patent No.: US 8,962,153 B2
(45) Date of Patent: Feb. 24, 2015

(54) HOT-DIP ZN—AL ALLOY COATED STEEL SHEET AND PRODUCING METHOD THEREFOR

(75) Inventors: Hideo Koumura, Tokyo (JP); Akihiko Furuta, Tokyo (JP); Yoshito Furuya, Tokyo (JP); Hideo Ogishi, Tokyo (JP); Susumu Sato, Tokyo (JP); Rie Umebayashi, Tokyo (JP); Satoru Ando, Hiroshima (JP); Shigeru Takano, Chiba (JP)

(73) Assignees: JFE Galvanizing & Coating Co., Ltd. (JP); JFE Steel Corporation (JP)

( * ) Notice: Subject to any disclaimer, the term of this patent is extended or adjusted under 35 U.S.C. 154(b) by 895 days.

(21) Appl. No.: 12/441,604

(22) PCT Filed: Nov. 8, 2007

(86) PCT No.: PCT/JP2007/072140

§ 371 (c)(1),
(2), (4) Date: May 12, 2009

(87) PCT Pub. No.: WO2008/056821

PCT Pub. Date: May 15, 2008

(65) Prior Publication Data

US 2010/0086806 A1 Apr. 8, 2010

(30) Foreign Application Priority Data

Nov. 10, 2006 (JP) ..... 2006-304666

(51) Int. Cl.
*B32B 15/01* (2006.01)
*C23C 2/06* (2006.01)

(52) U.S. Cl.
CPC ..... *C23C 2/06* (2013.01)
USPC ..... 428/659

(58) Field of Classification Search
USPC ..... 148/533
See application file for complete search history.

(56) References Cited

U.S. PATENT DOCUMENTS

| | | | | | |
|---|---|---|---|---|---|
| 4,152,472 | A * | 5/1979 | Ohbu et al. | ..... | 427/433 |
| 4,448,748 | A * | 5/1984 | Radtke et al. | ..... | 420/514 |
| 4,556,609 | A * | 12/1985 | Sato et al. | ..... | 427/433 |
| 6,030,714 | A * | 2/2000 | Fujibayashi et al. | ..... | 428/659 |
| 6,379,820 | B1 | 4/2002 | Komatsu et al. | | |
| 6,465,114 | B1 * | 10/2002 | Honda et al. | ..... | 428/659 |
| 6,709,770 | B2 * | 3/2004 | Komatsu et al. | ..... | 428/659 |
| 2004/0258949 | A1 * | 12/2004 | Honda et al. | ..... | 428/659 |

FOREIGN PATENT DOCUMENTS

| | | | |
|---|---|---|---|
| EP | 0 905 270 | A2 | 3/1999 |
| JP | 57-067153 | A | 4/1982 |
| JP | 04-297562 | A | 10/1992 |
| JP | 08-296014 | A | 11/1996 |
| JP | 10-226865 | A | 8/1998 |
| JP | 2001-064759 | A | 3/2001 |
| JP | 2001-329354 | A | 11/2001 |
| JP | 2003-183800 | A | 7/2003 |
| JP | 2004-068075 | A | 3/2004 |
| JP | 2004-143506 | A | 5/2004 |
| JP | 2006-124824 | A | 5/2006 |
| WO | 98/26103 | A1 | 6/1998 |
| WO | 2006/035527 | A1 | 4/2006 |

OTHER PUBLICATIONS

T. Lyman (ed.), Metals Handbook, vol. 8, Metallography Structures and Phase Diagrams, pp. 265, 397-399, American Society for Metals, 8th Edition (1973).*

V. Raghavan, Al—Mg—Zn (Aluminum—Magnesium—Zinc), J. Phase Equilibria and Diffusion, vol. 28, No. 2, pp. 203-208, ASM International (2007).*

* cited by examiner

*Primary Examiner* — Adam Krupicka
(74) *Attorney, Agent, or Firm* — DLA Piper LLP (US)

(57) ABSTRACT

A hot-dip Zn—Al alloy coated steel sheet exhibiting a beautiful coating appearance with metallic luster, in which no spangle or very fine spangles are formed, and having excellent blackening resistance and a method for manufacturing the hot-dip Zn—Al alloy coated steel sheet are provided. The hot-dip Zn—Al alloy coated steel sheet includes a hot-dip Zn—Al alloy coating layer containing 1.0 to 10 percent by mass of Al, 0.2 to 1.0 percent by mass of Mg, 0.005 to 0.1 percent by mass of Ni, and the balance being Zn and incidental impurities on at least one surface of a steel sheet. The manufacturing method includes the steps of dipping the steel sheet into a hot-dip Zn—Al alloy coating bath and pulling up and cooling the steel sheet, wherein the steel sheet pulled up from the coating bath is cooled to 250° C. at a cooling rate of 1° C. to 15° C./sec.

4 Claims, 9 Drawing Sheets

HOT-DIP ZN—AL ALLOY COATED STEEL SHEET AND PRODUCING METHOD THEREFOR

RELATED APPLICATIONS

This is a §371 of international Application No. PCT/JP2007/072140, with an international filing date of Nov. 8, 2007 (WO 2008/056821 A1, published May 15, 2008), which is based on Japanese Patent Application No. 2006-304666, filed Nov. 10, 2006.

TECHNICAL FIELD

This disclosure relates to a hot-dip Zn—Al alloy coated steel sheet, which is used in fields of architecture, civil engineering, household electrical appliance, and the like and which has an excellent coating appearance and excellent blackening resistance, and a method for manufacturing the hot-dip Zn—Al alloy coated steel sheet.

BACKGROUND

Hot-dip Zn—Al alloy coated steel sheets have been previously widely used as so-called precoated steel sheets having painted surfaces in fields of automobile, architecture, civil engineering, household electrical appliance, and the like. Hot-dip galvanized steel sheets having Al contents of 0.2 percent by mass or less in coating layers (hereafter referred to as GI), Galfan having an Al content of about 5 percent by mass in a coating layer (hereafter referred to as GF), and Galvalume steel sheets having Al contents of about 55 percent by mass in coating layers (hereafter referred to as GL) are mainly used as the hot-dip Zn—Al alloy coated steel sheet. In particular, in the field of architecture, civil, engineering, and the like, GF is used frequently on the ground that, for example, the cost is lower than the cost of GL and the corrosion resistance is superior to the corrosion resistance of GI.

However, GF has the following problems.

(i) Coating Appearance

Hexagonal patterned spangles are formed. The form of the spangle is different depending on coating conditions (for example, annealing before coating and components of a bath), cooling conditions after coating for example, cooling rate), and the like. Therefore, the appearance may be impaired in the case where the spangles are used without being covered. In the case where painting is performed and a color steel sheet is produced, spangles may come to a painting surface so as to impair the appearance after the painting. Consequently, in recent years, demands for GF having a beautiful coating layer with metallic luster and no spangle have increased.

(ii) Blackening Resistance

A so-called blackening phenomenon, in which a coating surface is discolored charcoal gray locally, may occur depending on a corrosive environment so as to impair a commercial value significantly. It is believed that the blackening occurs due to conversion of zinc oxide of the coating surface to oxygen-deficient zinc oxide in the case where the coating surface is placed in a high-temperature high-humidity environment or the like after coating. Relatively few problems occur in the case where a chemical conversion treatment and painting are performed just after coating. However, in many practical cases, packing is performed in the state of a coil after coating and the chemical conversion treatment and the painting arc performed after some period of time. Therefore, blackening occurs during the above-described period of time. In this case, the chemical conversion treatment may become faulty afterward. As a result, the adhesion of the painting film after the painting, the workability, the corrosion resistance, and the like may deteriorate and, thereby, the commercial value may be impaired significantly.

For the purpose of improving the blackening resistance and the like of the hot-dip Zn—Al alloy coated steel sheet having a GF composition, for example, the following proposals have been made previously.

Japanese Unexamined Patent Application Publication No. 2001-329354 discloses that more than 2 percent by mass to 10 percent by mass of Mg is added to a Zn—Al alloy coating layer containing 0.5 to 20 percent by mass of Al and the surface length factor of Zn—Al—Mg eutectic+Zn single phase of the coating surface is specified to be 50% or more for the purpose of improving the blackening resistance and the chemical conversion treatability. Furthermore, it is disclosed that at least one of Pb, Sn, Ni, and the like is added, if necessary, for the purpose of improving the chemical conversion treatability.

Japanese Unexamined Patent Application Publication No. 2003-183800 discloses that regarding, a chromate-treated hot-dip Zn—Al alloy coated steel sheet, 0.003 to 0.15 percent by mass of Ni and/or Ti is added to a Zn—Al alloy coating layer containing 2 to 15 percent by mass of Al, a chromate treatment is performed with a specific chromate treatment solution to allow concentrated Ni and/or Ti to present in an outermost surface portion of the coating layer, and the resulting Ni and/or Ti concentration portion and the interface of a chromate layer are integrated for the purpose of improving the blackening resistance and the corrosion resistance.

Japanese Unexamined Patent Application Publication No. 4-297562 discloses that regarding a Zn—Al alloy coating layer containing 4.0 to 7.0 percent by mass of Al, the Pb content is specified to be 0.01 percent by mass or less and the Sn content is specified to be 0.005 percent by mass or less, 0.005 to 3.0 percent by mass of Ni and 0.005 to 3.0 percent by mass of Cu are added, and a skin pass treatment and a chromate treatment are performed after the coating for the purpose of improving the blackening resistance.

Although the purpose is other than the improvement of the blackening resistance, Japanese Unexamined Patent Application Publication No. 2001-64759 discloses that 0.1 to 10 percent by mass of Mg is added to a Zn—Al alloy coating layer containing 0.1 to 40 percent by mass of Al so as to constitute a texture, in which Mg based intermetallic compound phases having a predetermined size are dispersed, for the purpose of improving the workability. Furthermore, it is disclosed that at least one of Ni, Ti, Sb, and the like is added, if necessary, for the purpose of improving the sliding resistance.

However, those disclosures continue to pose challenges.

Regarding the coated steel sheet of Japanese Unexamined Patent Application Publication No. 2001-329354, even when the blackening resistance can be improved to some extent, poor appearance of coating easily occurs due to degradation of color tone and dross adhesion. Furthermore, cracking easily occurs in the coating layer and, thereby, the workability easily deteriorates. If the Mg content increases, the blackening resistance also deteriorates.

Regarding the chromate-treated coated steel sheets of Japanese Unexamined Patent Application Publication Nos. 2003-183800 and 4-297562, the effect of improving the blackening resistance is unsatisfactory. Furthermore, poor appearance of a coated steel sheet or a painted steel sheet easily occurs because spangles are formed as in common GF. Regarding Japanese Unexamined Patent Application Publication No. 2003-183800, the chromate treatment by using a specific chromate treatment solution is required.

Regarding the coated steel sheet of Japanese Unexamined Patent Application Publication No. 2001-64759, one of problems, e.g., deterioration of the blackening resistance, poor appearance of coating due to degradation of color tone and dross adhesion, or poor appearance due to formation of spangles, occurs.

It could therefore be helpful to provide a hot-dip Zn—Al alloy coated steel sheet exhibiting a beautiful coating appearance with metallic luster, in which no spangle or very fine spangles are formed, and having excellent blackening resistance and a method for manufacturing the hot-dip Zn—Al alloy coated steel sheet.

SUMMARY

We conducted intensive research on an improved coating composition and a structure as well as a coating treatment process. As a result, regarding the hot-dip Zn—Al alloy coating composition, we found that a hot-dip Zn—Al alloy coated steel sheet exhibiting a beautiful coating appearance with metallic luster, in which no spangle or very fine spangles were formed, and having excellent blackening resistance was able to be produced by adopting an Al concentration in a general GF as a base and allowing this to contain appropriate amounts of Mg and Ni. Furthermore, we found that further excellent blackening resistance was able to be obtained by controlling the cooling rate after coating within a specific range so as to facilitate concentration of Ni into an outermost surface portion of a coating layer due to a synergetic effect of Mg and Ni.

We thus provide:

[1] A hot-dip Zn—Al alloy coated steel sheet characterized by including a hot-dip Zn—Al alloy coating layer containing 1.0 to 10 percent by mass of Al, 0.2 to 1.0 percent by mass of Mg, 0.005 to 0.1 percent by mass of Ni, and the balance being Zn and incidental impurities on at least one surface of a steel sheet.

[2] The hot-dip Zn—Al alloy coated steel sheet according to the above-described item [1], characterized in that Ni is concentrated in an outermost surface layer portion of the hot-dip Zn—Al alloy coating layer.

[3] The hot-dip Zn—Al alloy coated steel sheet according to the above-described item [1] or item [2], characterized in that the hot-dip Zn—Al alloy coating layer includes binary eutectic of Zn—Al and ternary eutectic of Al—Zn—Mg intermetallic compound.

[4] The hot-dip Zn—Al alloy coated steel sheet according to the above-described item [3], characterized in that the Mg intermetallic compound is $MgZn_2$.

[5] The hot-dip Zn—Al alloy coated steel sheet according to the above-described item [3] or item [4], characterized in that the hot-dip Zn—Al alloy coating layer includes 10 to 30 percent by area of ternary eutectic of Al—Zn—Mg intermetallic compound on a cross-section of the coating layer basis.

[6] The hot-dip Zn—Al alloy coated steel sheet according to any one of the above-described items [3] to [5], characterized in that the average major diameter of the binary eutectic of Zn—Al is 10 μm or less.

[7] A method for manufacturing a hot-dip Zn—Al alloy coated steel sheet, comprising the steps of dipping a steel sheet into a hot-dip Zn—Al alloy coating bath and pulling up and cooling the steel sheet so as to form a hot-dip Zn—Al alloy coating layer on a steel sheet surface, characterized in that the steel sheet pulled up from the above-described coating bath is cooled to 250° C. at a cooling rate of 1° C. to 15° C./sec, and the hot-dip Zn—Al alloy coating layer contains 1.0 to 10 percent by mass of Al, 0.2 to 1.0 percent by mass of Mg, 0.005 to 0.1 percent by mass of Ni, and the balance being Zn and incidental impurities.

The hot-dip Zn—Al alloy coated steel sheet exhibits a beautiful coating appearance with metallic luster, in which no spangle or very fine spangles are formed, and has excellent blackening resistance while excellent workability specific to CF is maintained.

A hot-dip Zn—Al alloy coated steel sheet exhibiting a beautiful coating appearance with metallic luster, in which no spangle or very fine spangles are formed, and having particularly excellent blackening resistance can be produced by the manufacturing method.

DETAILED DESCRIPTION

Figure 1:
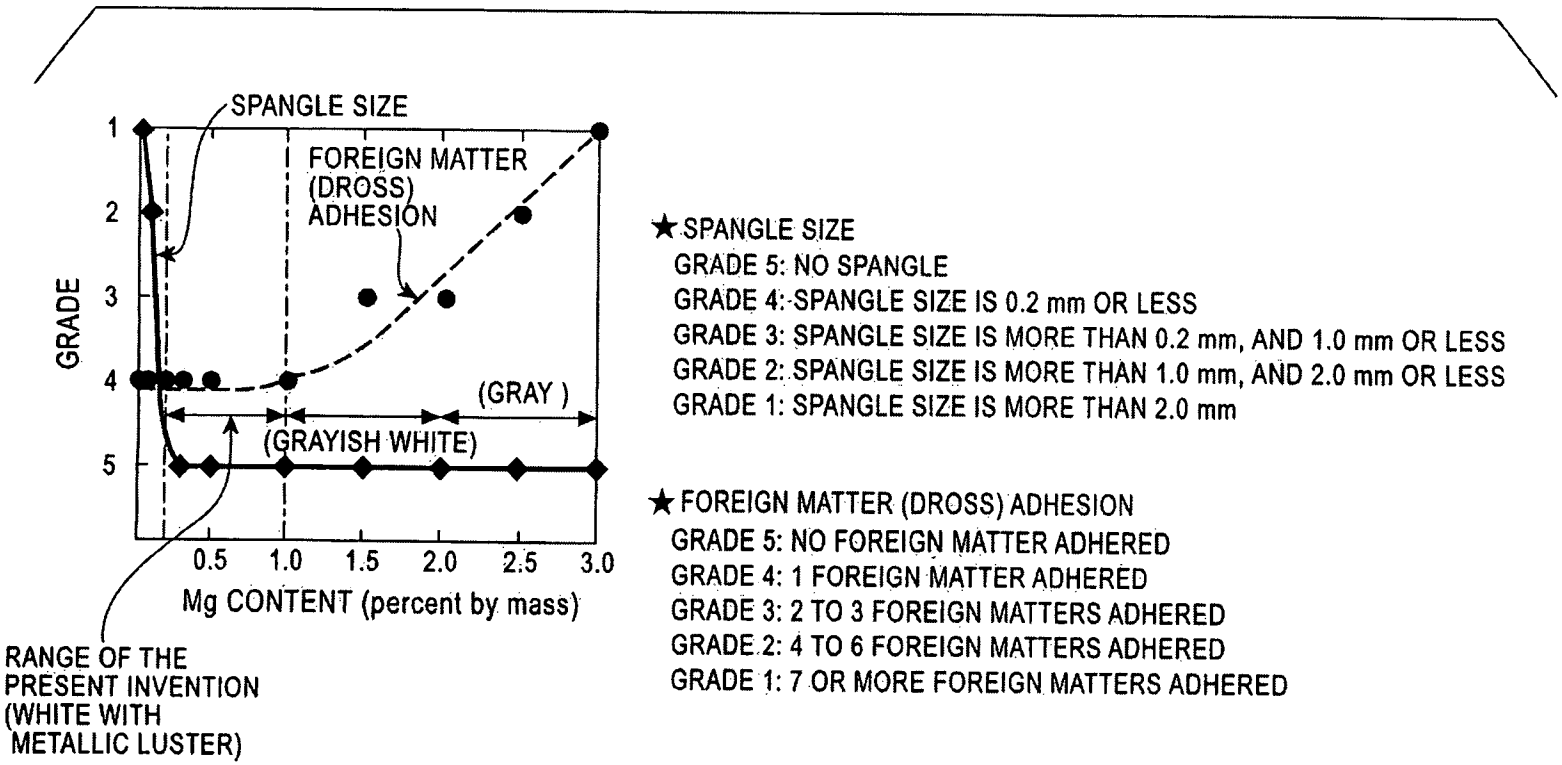
FIG. 1 is a graph showing the relationship between the Mg content in a coating layer and the coating appearance regarding a hot-dip Zn—Al alloy coated steel sheet including the coating layer with a GF composition containing an appropriate amount of Ni.

A hot-dip Zn—Al alloy coated steel sheet (sometimes hereafter referred to as "our coated steel sheet") includes a hot-dip Zn—Al alloy coating layer containing 1.0 to 10 percent by mass of Al, 0.2 to 1.0 percent by mass of Mg, 0.005 to 0.1 percent by mass of Ni, and the remainder composed of Zn and incidental impurities on at least one surface of a steel sheet.

In our coated steel sheet, Mg is added to the hot-dip Zn—Al alloy coating layer mainly for the purpose of obtaining a beautiful coating appearance with metallic luster, in which no spangle or very fine spangles are formed, and Ni is added to the above-described coating layer mainly for the purpose of improving the blackening resistance. Concentration of Ni into an outermost surface portion of the coating layer due to coexistence of an appropriate amount of Mg is required for the improvement of the blackening resistance through addition of Ni. Furthermore, the concentration of Ni into the outermost surface portion of the coating layer can be effected more appropriately by controlling the cooling rate after coating within an appropriate range.

Reasons for the selection of the component composition of the hot-dip Zn—Al alloy coating layer (hereafter referred to as a "coating layer" simply) will be described below.

If the Al content in the coating layer is less than 1.0 percent by mass, a thick Fe—Zn alloy layer is formed at the interface between the coating layer and a substrate so as to deteriorate the workability. On the other hand, if the Al content exceeds 10 percent by mass, an eutectic texture of Zn and Al is not obtained, and an Al-rich layer increases so as to deteriorate the sacrificial protection function. Consequently, the corrosion resistance of an end surface portion becomes poor. Moreover, when it is intended to obtain a coating layer having an Al content exceeding 10 percent by mass, top dross primarily containing Al easily occurs in a coating bath and, thereby, a problem occurs in that the coating appearance is impaired. For the above-described reasons, the Al content in the coating layer is specified to be 1.0 to 10 percent by mass, and preferably 3 to 7 percent by mass.

We sought to eliminate a spangle (achieve zero-spangle) specific to the hot-dip Zn—Al alloy coating having a GF composition or form very fine spangles and to obtain a beautiful coating appearance with metallic luster without defective coating. We thus conducted the following experiment to examine the relationship between the coating composition and the coating appearance.

Merely Mg was added to a hot-dip Zn—Al alloy coating bath containing Al of GF composition (4 to 5 percent by mass) and merely Ni is added to another coating bath. Steel sheets were subjected to hot-dip Zn—Al alloy coating with these coating baths. The coating appearance (in particular, the spangle size, the degree of dross adhesion, the color tone, and the gloss) of each of the resulting coated steel sheet was observed visually. As a result, regarding the coating layer containing Ni no change was observed in the coating appearance in the range of experiment, and the coating appearance was almost equal to that of common GF. However, regarding the coating layer containing Mg, the spangle size, the color tone, and the gloss were changed depending on the amount of addition of Mg.

A steel sheet was plated by using, a hot-dip Zn—Al alloy coating bath prepared by adding 0 to 3 percent by mass of Mg to the hot-dip Zn—Al alloy coating bath (total content of Ce and La as a misch metal was 0.008 percent by mass) containing 4 to 5 percent by mass of Al and 0.03 percent by mass of Ni. The relationship between the Mg content in the coating layer and the coating appearance (the spangle size, the degree of dross adhesion, and the color tone) was examined. The results thereof are shown in FIG. 1. According to this, the spangle size begins to become finer as the Mg content becomes 0.1 percent by mass or more. The spangle is almost eliminated and the color tone becomes a tinge of white with metallic luster as the Mg content becomes 0.2 percent by mass or more. If the Mg content is less than 0.2 percent by mass, the blackening resistance also deteriorates. This is because, as described later, concentration of Ni into the outermost surface layer portion of the coating layer does not occur when the content of Mg coexistent with Ni in the coating layer is less than 0.2 percent by mass and, as a result, the blackening resistance deteriorates. On the other hand, if the Mg content exceeds 1.0 percent by mass, the color tone changes to grayish white and to gray sequentially, and dross adhesion increases. Furthermore, if the Mg content exceeds 1.0 percent by mass, there are problems in that cracking easily occurs in the coating layer and the workability deteriorates. If the Mg content is too large, the blackening resistance deteriorates.

Therefore, the lower limit of the Mg content in the coating layer is specified to be 0.2 percent by mass to obtain a beautiful coating appearance and excellent blackening resistance, and the upper limit is specified to be 1.0 percent by mass from the viewpoint of preventing dross adhesion and deterioration of color tone and furthermore, preventing deterioration of workability.

As described above, regarding the coating composition, Mg mainly contributes to improvement of the coating appearance and Ni mainly contributes to improvement of the blackening resistance. We was found that for Ni, the coexistence with Mg was indispensable to exert the effect of improving the blackening resistance. That is, we found that Mg had a function of forming a beautiful coating appearance and, in addition, Mg facilitated indirectly the effect of improving the blackening resistance through coexistence, with Ni. This was able to be made clear by analyzing the coating layers in the depth direction by using glow discharge optical emission spectroscopy (GDS) regarding coated steel sheets having different blackening resistance. An example of the analytical results is described below.

Regarding three types of hot-dip Zn—Al alloy coated steel sheets having GF compositions (in each case, the rate of cooling to 250° C. after coating was 5° C./sec), as described in the following items (1) to (3), the form of concentration of each element of Al, Zn, Mg, and Ni was examined in the depth direction from the coating layer surface:

(1) A coated steel sheet containing merely Mg in a coating layer and exhibiting poor blackening resistance,
(2) A coated steel sheet containing merely Ni in a coating layer and exhibiting poor blackening resistance.
(3) A coated steel sheet containing Mg and Ni in a coating layer and exhibiting excellent blackening resistance.

Figure 2:
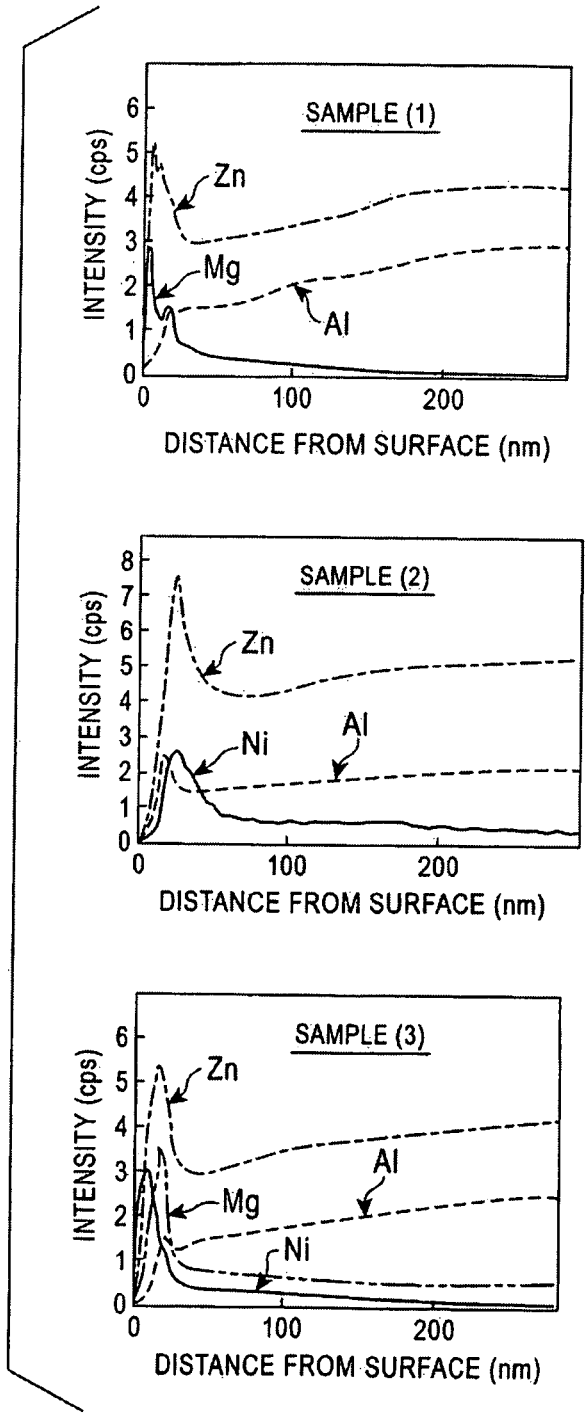
FIG. 2 includes graphs showing the results of analyses of compositions in a depth direction of coating layers regarding, a coated steel sheet containing merely Mg in the coating layer, a coated steel sheet containing merely Ni in the coating layer, and a coated steel sheet containing Mg and Ni in the coating layer, the coating layers being hot-dip Zn—Al alloy coated steel sheets with the CF compositions.

We believed that the blackening was a problem of the coating surface. Therefore, portions from the outermost surface to the depth of about 200 nm (2,000 Å) of samples (coated steel sheets) of the above-described items (1) to (3) were analyzed intensively. The results thereof are shown in FIG. 2. In this analysis of coating component elements, a GDS analyzer was used, and the analysis was performed by discharging in the depth direction at an anode diameter of 4 mm and a current of 20 mA for 30 seconds.

As is shown in FIG. 2, each of the samples of the above-described items (1) to (3) exhibits a peak of each concentrated coating component in the vicinity of the coating surface. It is clear that the concentration form of each element is subtly different from one sample to another.

Regarding the coating layer of the sample (1) containing merely Mg and exhibiting poor blackening resistance, the peak of concentrated Mg is observed at nearly the same position as that of Zn of the outermost layer portion (outermost surface), and the peak of concentrated Al is observed on the side (basis material side) inner than the peaks of concentrated Zn and Mg.

Regarding the concentration peaks of the coating layer of the sample (2) containing merely Ni and exhibiting poor blackening resistance, Al is observed following Zn of the outermost layer portion, and the peak of concentrated Ni is observed on the side (basis material side) inner than the peak of concentrated Al.

On the other hand, regarding the coating layer of the sample (3) containing Mg and Ni and exhibiting excellent blackening resistance, the peak of concentrated Ni is observed in the outermost surface layer portion similarly to Zn, and each of the peaks of concentrated Mg and Al is observed on the side (basis material side) inner than the peak of concentrated Ni.

Although not shown in FIG. 2, a coated steel sheet, in which Mg and Ni coexist in the coating layer in the same amount as those in the sample (3), which was produced at the rate of cooling to 250° C. after the coating of 30° C./sec, and which did not exert significant effect on the blackening resistance, was similarly analyzed. It was found that concentration of Ni into the outermost surface layer portion of the coating layer was less than the concentration of Ni in the sample (3).

From the above-described analytical results, we found that Ni was concentrated into the outermost layer portion of the coating layer exhibiting excellent blackening resistance and the coexistence of Mg is required for the concentration of Ni into the outermost layer portion. Furthermore, we found that the concentration of Ni is influenced by the cooling rate after the coating.

From the above-described results of analysis with fluorescent X-rays, we estimated that the concentration of Ni is present between the outermost surface of the coating and a position at a depth of about 30 nm (300 Å).

In general, from the viewpoint of the standard energy of oxide generation, Al and Mg have a strong property of being oxidized as compared with that of Zn. Conversely, Ni is an element having a weak property of being oxidized. We assumed that a coating component element having a strong property of being oxidized diffuses (moves and concentrates) to the outermost surface of the coating layer and takes away a part of oxygen of zinc oxide which have been generated on the outermost surface of the coating layer to convert zinc oxide to oxygen-deficient zinc oxide and, thereby, blackening occurs. Therefore, without being bound by any specific theory, we believe that Mg concentrated into the outermost layer portion takes away oxygen of zinc oxide in the coating layer of the sample (1) exhibiting poor blackening resistance to convert zinc oxide to oxygen-deficient zinc oxide. Likewise, Al having a strong property of being oxidized takes away oxygen of zinc oxide in the coating layer of the sample (2) exhibiting poor blackening resistance to convert zinc oxide to oxygen-deficient zinc oxide because Al is concentrated on the side nearer to the surface layer than is Ni.

On the other band, we believe that Ni having a weak property of being oxidized is concentrated into the outermost surface layer portion of the coating layer of the sample (3) exhibiting excellent blackening, resistance. This serves as a barrier layer to suppress diffusion (movement and concentration) of coexisting Mg and Al into the outermost surface layer portion and, thereby, the blackening resistance is improved.

That is, the improvement of blackening resistance requires that Ni is concentrated into the outermost surface layer portion of the coating layer to serve as a barrier layer. The concentration of Ni into the outermost surface layer portion of the coating layer is believed to occur by coexistence of Mg. However, the mechanism of the movement and concentration of Ni into the outermost surface layer portion of the coating layer due to coexistence with Mg is not completely certain under the present circumstances.

If the Ni content in the coating layer is less than 0.005 percent by mass, the degree of concentration of Ni into the outermost surface layer portion of the coating layer is low even when Mg is present together, so that an effect of improving the blackening resistance is not exerted. Conversely, even when the Ni content is 0.005 percent by mass or more, if the Mg content is less than 0.2 percent by mass, concentration of Ni into the outermost surface layer portion does not occur.

If the Ni content exceeds 0.1 percent by mass, although the effect of improving the blackening resistance is exerted, Al—Mg dross containing Ni occurs in the coating bath, and the coating appearance is impaired due to dross adhesion unfavorably.

For the above-described reasons, the Ni content in the coating layer is specified to be 0.005 to 0.1 percent by mass and, as described above, the Mg content is specified to be 0.2 to 1.0 percent by mass.

In this manner, a hot-dip Zn—Al alloy coated steel sheet exhibiting a beautiful coating appearance with metallic luster, in which no spangle or very fine spangles are formed, and having excellent blackening resistance can be produced by allowing the coating layer having a GF composition to contain appropriate amounts of Mg and Ni.

The coating layer of the coated steel sheet can include a misch metal containing Ce and/or La. This misch metal containing Ce and/or La has no effect on achievement of zero-spangle but performs the functions of increasing the fluidity of the coating bath, preventing occurrence of a fine defective-coating-like pinhole, and smoothing the coating surface.

If the misch metal content is less than 0.005 percent by mass in total of Ce and La, the effect of suppressing the occurrence of pinholes is insufficient, and there is no effect on smoothing the surface. On the other hand, if the total content of Ce and La exceeds 0.05 percent by mass, they are present in the coating bath as undissolved suspended matter, and they adhere to the coating surface so as to impair the coating appearance. Therefore, it is favorable that the content of misch metal containing Ce and/or La is 0.005 to 0.05 percent by mass in total of Ce and La, and desirably 0.007 to 0.02 percent by mass.

Figure 3:
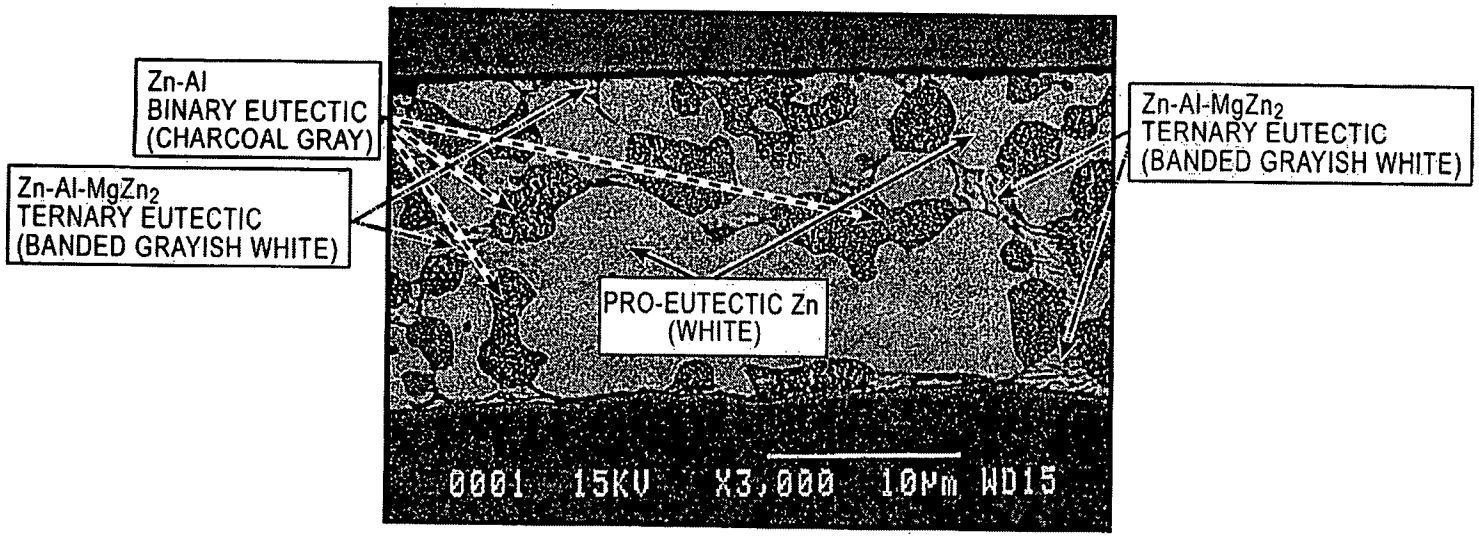
FIG. 3 is a SEM photograph of a cross-section of coating layer of a hot-dip Zn—Al alloy coated steel sheet.
Figure 4:
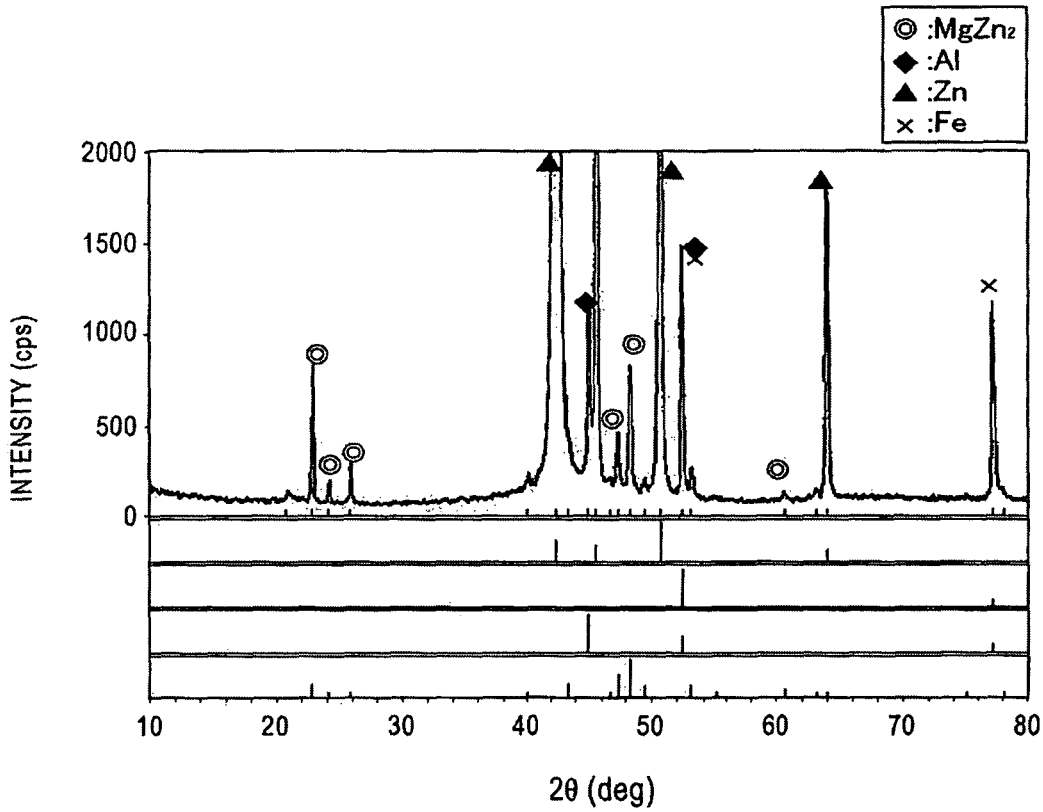
FIG. 4 is a diagram showing the result of X-ray diffraction of a coating layer of a hot-dip Zn—Al alloy coated steel sheet.
Figure 5:
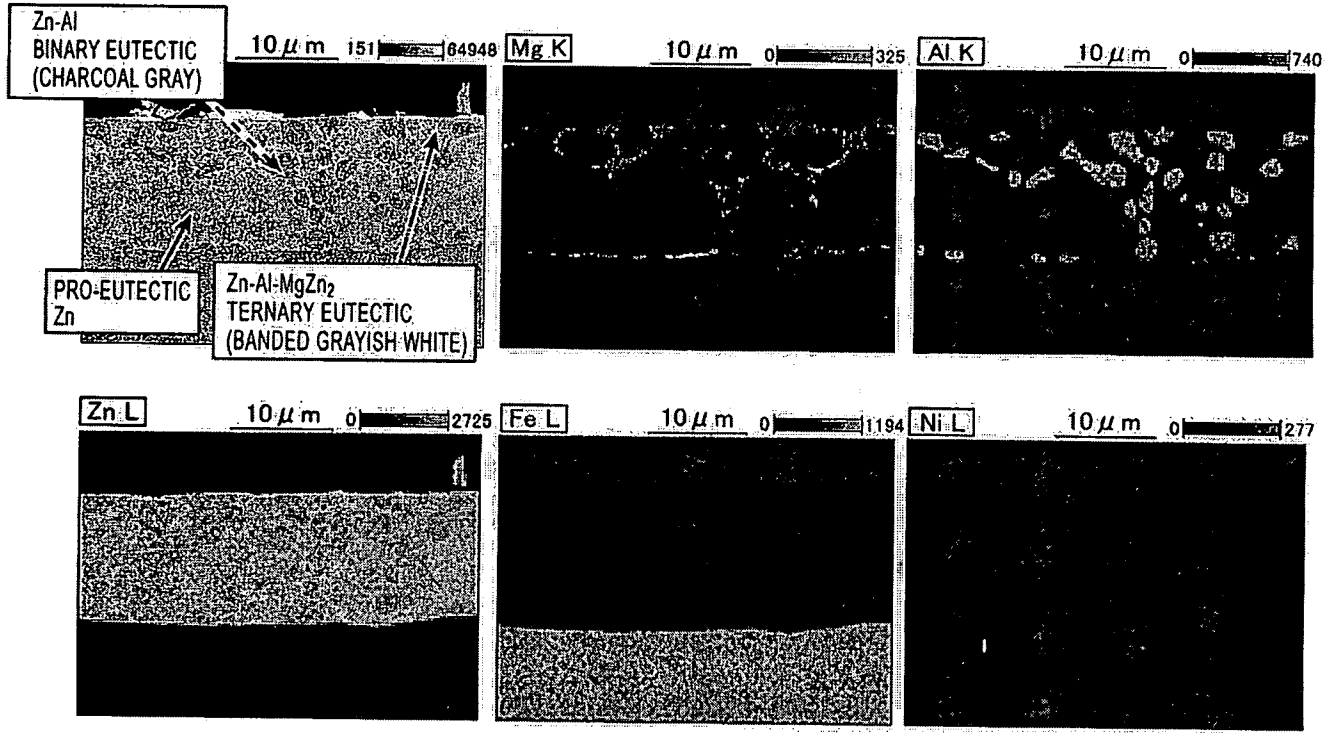
FIG. 5 includes drawings showing the results of EDX analyses of cross-sections of coating layers of hot-dip Zn—Al alloy coated steel sheets.
Figure 6:
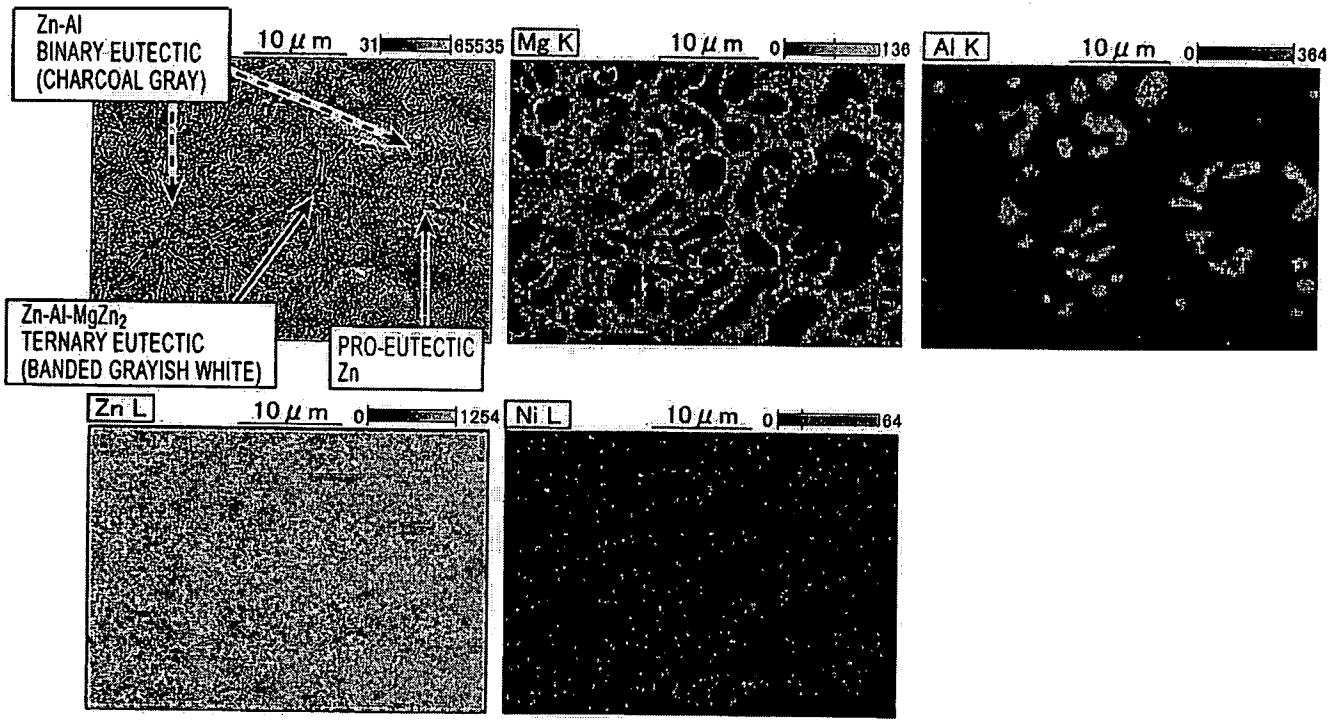
FIG. 6 includes drawings showing the results of EDX analyses of surfaces of coating layers of hot-dip Zn—Al alloy coated steel sheets.

FIG. 3 is a SEM photograph of a cross-section of coating layer (Al: 4.4 percent by mass, Mg: 0.6 percent by mass, Ni: 0.03 percent by mass, the remainder: Zn) of the coated steel sheet. According to the above-described SEM photograph, fine-grained charcoal gray precipitates were interspersed in pro-eutectic Zn (white portion), and grayish white precipitates with a banded pattern were observed along charcoal gray precipitates. This coating layer was subjected to X-ray diffraction from a surface and was subjected to element analysis by EDX from a cross section and a surface. FIG. 4 shows the result of X-ray diffraction. FIG. 5 shows the results of EDX analyses of cross sections of coating layers (EDX element mapping and EDX spectrum, mapping data type: net count, magnification: 3,000 times, acceleration voltage: 5.0 kV). FIG. 6 shows the results of EDX analyses of surfaces of coating layers (EDX element mapping and EDX spectrum, mapping data type: net count, magnification: 3,000 times, acceleration voltage: 10.0 kV).

From these results, $MgZn_2$ was identified as intermetallic compound in the coating layer of the coated steel sheet. The line-grained charcoal gray precipitates were estimated to be Zn—Al binary eutectic primarily containing Al, and were interspersed throughout the coating layer. It Was estimated that the grayish white banded pattern was ternary eutectic of $MgZn_2$, Zn, and Al (hereafter referred to as Zn—Al—$MgZn_2$ ternary eutectic) primarily containing $MgZn_2$ identified as the intermetallic compound. This ternary eutectic spread into the shape of a network particularly in the vicinity of the coating layer surface, and the fine-grained An-Al binary eutectic was interspersed in this network.

Figure 7:
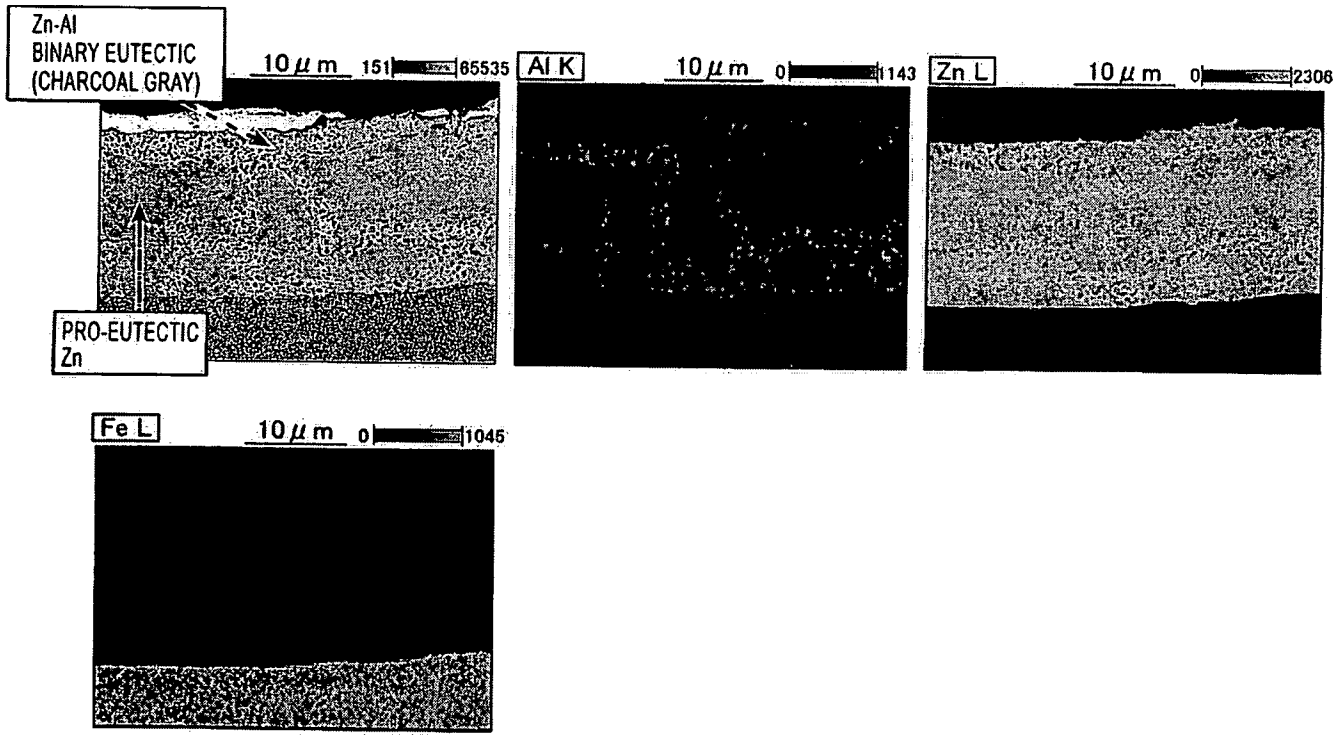
FIG. 7 includes drawings showing the results of EDX analyses of cross-sections of coating layers of common GF.
Figure 8:
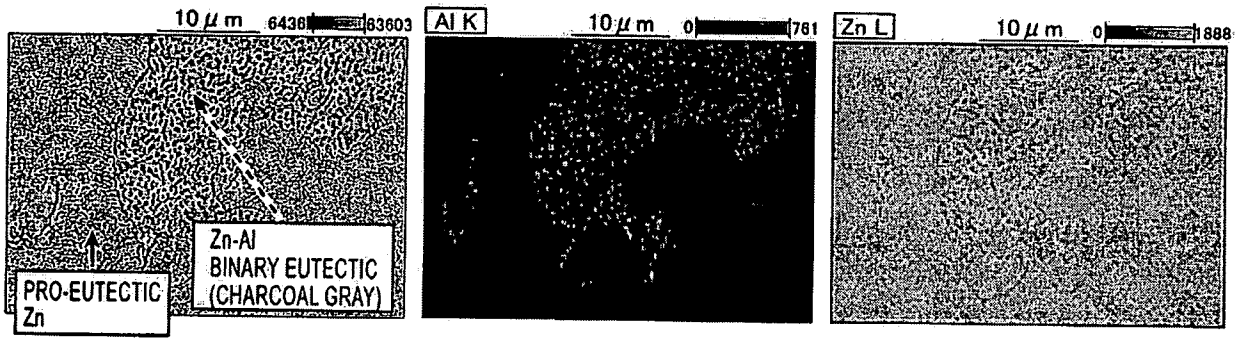
FIG. 8 includes drawings showing the results of EDX analyses of surfaces of coating layers of common GF.

For purposes of comparison, a cross-section and a surface of the coating layer of common GF (Al: 4.3 percent by mass, the remainder: Zn) were subjected to EDX analysis. FIG. 7 shows the results of EDX analyses of cross-sections of coating layers (EDX element mapping and EDX spectrum, mapping data type: net count, magnification: 3,000 times, acceleration voltage: 5.0 kV). FIG. 8 shows the results of EDX analyses of surfaces of coating layers (EDX element mapping and EDX spectrum, mapping data type: net count, magnification: 3,000 times, acceleration voltage: 10.0 kV). The coating layer of this GF is composed of white pro-eutectic Zn and charcoal gray Zn—Al binary eutectic. This binary eutectic presents on the coating layer surface and in the vicinity of the interface continuously and is large significantly as compared with the Zn—Al binary eutectic of the coated steel sheet.

Although the data is not provided, Zn—Al binary eutectic was present in the center portion of the hexagonal patient. Therefore, it was believed that the Zn—Al binary eutectic serves as a core for forming the hexagonal pattern.

Consequently, regarding the Zn—Al binary eutectic and the Zn—Al—$MgZn_2$ ternary eutectic in the coating layer of the coated steel sheet, particle diameters, fractions of eutectic phases, and the like were examined in detail. As a result, we found that in our coated steel sheets, the fraction of eutectic phase of the Zn—Al—$MgZn_2$ ternary eutectic was 10 to 30 percent by area in terms of an area percentage in a coating layer cross-section, and a beautiful coating appearance without hexagonal pattern was able to be obtained at such a fraction of eutectic phase. This mechanism is not completely certain in detail, but is estimated as described below from the above-described analytical results. If it is assumed that the Zn—Al binary eutectic serves as a core of the hexagonal pattern of GF, continuous large Zn—Al binary eutectic is formed in common GF and, thereby, a state in which few cores are present is brought about, and the hexagonal pattern is formed and grown. However, in the coating layer containing Mg, the Zn—Al—$MgZn_2$ ternary eutectic forms a network during solidification, the Zn—Al binary eutectic, which serves as a core of the hexagonal pattern, is segmented and fine-grained, so that cores increase. As a result, a beautiful coating appearance without hexagonal pattern can be obtained.

The above-described coated steel sheet was bent and the surface and the cross-section of the coating layer were observed with an optical microscope. When bending was performed at 2T or more, the degree of occurrence of cracking was nearly equal to that of GF. Therefore, it was determined that the workability in common bending was nearly equal to the workability of GF.

The fraction of eutectic phase of the Zn—Al—$MgZn_2$ ternary eutectic (area percentage in a coating layer cross-section of the Zn—Al—$MgZn_2$ ternary eutectic and, hereafter, the same holds true) becomes less than 10 percent by area in the case were the Mg content in the coating layer is less than 2 percent by mass. Since formation of Zn—Al—$MgZn_2$ ternary eutectic is at a low level, the Zn—Al binary eutectic is fine-grained insufficiently, and spangles are formed. On the other hand, the fraction of eutectic phase of the Zn—M—$MgZn_2$ ternary eutectic exceeds 30 percent by area in the case where the Mg content in the coating layer exceeds 1.0 percent by mass. The coating appearance is beautiful. However, the hardness of the coating layer increases as the content of $MgZn_2$ increases. Consequently, large cracking easily occurs during bending, and the workability deteriorates.

The particle diameter of the Zn—Al binary eutectic is affected by the fraction of eutectic phase of the Zn—Al—$MgZn_2$ ternary eutectic. If this fraction of eutectic phase of the Zn—Al—$MgZn_2$ ternary eutectic is within the range of 10 to 30 percent by area, the average major diameter becomes 10 μm or less. The major diameter of the Zn—Al binary eutectic exceeds 10 μm in the case where the Mg content in the coating layer is less than 2 percent by mass. The Zn—Al binary eutectic is fine-grained insufficiently, and formation of fine hexagonal patterns is started, so that a beautiful coating appearance with metallic luster is not obtained.

Figure 9:
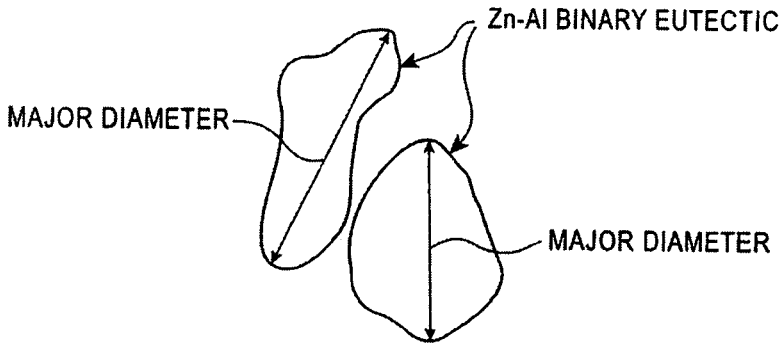
FIG. 9 is an explanatory diagram showing the definition of a major diameter of binary eutectic of Zn—Al.

The fraction of eutectic phase of the Zn—Al—$MgZn_2$ ternary eutectic and the particle diameter (average major diameter) of the Zn—Al binary eutectic are measured as described below. At least eight objects are randomly selected from a SEM photograph (for example, magnification is 3,000 times) of a cross-section of the coating layer. Regarding each object, the area of the entire coating layer is determined. Subsequently, the area of the Zn—Al—$MgZn_2$ ternary eutectic is determined and a proportion of the area in the entire coating layer is calculated on an object basis. The average value of them is taken as the fraction of eutectic phase. Regarding an object of a similar SEM photograph of a cross-section, the maximum length of each Zn—Al binary eutectic (refer to FIG. 9) is measured as the major diameter, and the average value of them is taken as the average major diameter.

A method for manufacturing our coated steel sheets will be described below.

The steel sheet to be used as a substrate steel sheet may be selected appropriately from known steel sheets in accordance with the use and is not specifically limited. For example, it is preferable that a low carbon aluminum killed steel sheet or an ultra low carbon steel sheet is used from the viewpoint of a coating operation.

In the method for manufacturing the coated steel sheet, a steel sheet (substrate steel sheet) is dipped m a hot-dip Zn—Al alloy coating bath, hot-dip (melt) coating is performed and, thereafter, the steel sheet is pulled up from the above-described coating bath and is cooled, so that a hot-dip Zn—Al alloy coating layer is formed on a steel sheet surface. The resulting coating layer contains 1.0 to 10 percent by mass of Al, 0.2 to 1.0 percent by mass of Mg, 0.005 to 0.1 percent by mass of Ni, and the remainder composed of Zn and incidental impurities. Therefore, preferably, the bath composition of the hot-dip Zn—Al alloy coating bath is adjusted to become substantially the same as the ahoy coating layer composition.

As described above, Ni is concentrated into the outermost surface layer portion of the hot-dip Zn—Al alloy coating layer.

We conducted intensive research particularly on the Mg and Ni contents in the hot-dip Zn—Al alloy coating layer, the cooling rate after the coating, and the behavior of concentration of coating component elements into the outermost surface layer portion of the coating layer. As a result, we found that the coexistence of Mg with Ni was indispensable for improving the blackening resistance, that is, concentration of Ni into the outermost surface layer portion of the coating layer, as described above, and this concentration of Ni was also influenced significantly by the rate of cooling to 250° C. after coating.

It is known that metals e.g., Al, Mg, and Ni, in the hot-dip Zn—Al alloy coating layer gradually diffuse toward the outermost surface of the coating layer during the time period until the metals are solidified and reach ambient temperature after the coating. In particular, we found that the concentration of Ni into the outermost surface of the coating layer was influenced significantly by the rate of cooling to 250° C. after the coating. On the other hand, the cooling rate in the range lower than 250° C. had almost no influence on the concentration of Mg and Ni.

Specifically, we found that the concentration of Ni into the outermost surface layer portion of the coating layer was able to be facilitated more effectively by controlling the rate of cooling of the coated steel sheet pulled up from the hot-dip Zn—Al alloy coating bath to 250° C. at 1° C. to 15° C./sec, and preferably 2° C. to 10° C./sec. If the rate of cooling of the coated steel sheet pulled up from the coating bath to 250° C. is less than 1° C./sec, although Ni is concentrated into the outermost surface layer portion of the coating layer, an alloy layer grows in the coating layer, hexagonal patterns are formed so as to impair the appearance and cause deterioration of workability. On the other hand, if the cooling rate exceeds 15° C./sec, concentration of Ni into the outermost surface layer portion of the coating layer is reduced even when the Mg content is within the range of 0.2 to 1.0 percent by mass and the Ni content is within the range of 0.005 to 0.1 percent by mass in the coating layer, and a significant effect is not exerted on the blackening resistance. If the rate of cooling to 250° C. exceeds 15° C./sec, the fraction of eutectic phase of the Zn—Al—$MgZn_2$ ternary eutectic in the coating layer may become less than 10%, and fine hexagonal patterns may be formed. Consequently, it is preferable that the rate of cooling of the coated steel sheet pulled up from the hot-dip Zn—Al alloy coating bath to 250° C. is specified to be 1° C. to 15° C./sec, and desirably 2° C. to 10° C./sec.

Preferably, the coating bath temperature is specified to be within the range of 390° C. to 500° C. If the coating bath temperature is lower than 390° C., the viscosity of the coating bath increases and the coating surface easily becomes uneven. On the other hand, if the temperature exceeds 500° C., the dross in the coating bath easily increases.

The coating layer surface (in the case where both surfaces are provided with coating layers, the surface of at least one coating layer) of the coated steel sheet may be coated with a resin so that a resin-coated steel sheet may be produced. This resin-coated steel sheet is usually produced by forming chemical-conversion-treated layer on the coating layer surface, and forming a resin layer thereon. If necessary, a primer layer may be disposed between the chemical-conversion-treated layer and the resin layer.

The chemical-conversion-treated layer, the primer layer, and the resin layer to be applied may be those adopted for a common precoated steel sheet.

For the formation of the above-described chemical-conversion-treated layer, a chromate treatment with a common treatment solution containing Chromic acid, dichromic acid, or a salt thereof as a primary component may be applied. Alternatively, a chromium-free treatment with, for example, a titanium or zirconium based treatment solution containing no chromium may be applied.

The above-described primer layer can be formed by, for example, applying a primer in which a rust-resistant pigment (for example, at least one type of zinc chromate, strontium chromate, barium chromate, and the like) and a curing agent (at least one type of melamine, an isocyanate resin, and the like) are blended to at least one organic resin of an epoxy resin, a polyester resin, a modified polyester resin, a modified epoxy resin, and the like. A high-workability painting film can also be produced by adding a color pigment or an extender pigment to the primer.

The above-described resin layer can be formed by applying and baking an appropriate amount of topcoat paint, e.g., a generally known polyester paint, fluororesin paint, acrylic resin paint, vinyl chloride based paint, and silicone resin paint. The film thickness of the resin layer and the application method (spray coating, roll coating, brush coating, or the like) may be the same as those for a common precoated steel sheet.

The baking (drying) condition in formation of the above-described chemical-conversion-treated layer, the primer layer, and the resin layer may be a generally adopted condition of 50° C. to 280° C.×30 seconds or more

EXAMPLES in a continuous hot-dip Zn—Al alloy coating facility, an unannealed Al killed steel, sheet having a sheet thickness of 0.5 mm and a sheet width of 1,500 mm was hot-dip plated so as to produce a hot-dip Zn—Al alloy coated steel sheet. The coating appearance and the blackening resistance of the resulting coated steel sheet were evaluated. The results thereof are shown in Table 1 and Table 2 together with the coating composition (average composition), the presence or absence and the degree of concentration of Ni into the outermost surface layer portion of the coating layer, and the coating treatment condition (coating bath temperature, time of dipping in bath, rate of cooling to 250° C. after coating) of each coated steel sheet.

The fraction of eutectic phase of the Zn—Al—$MgZn_2$ ternary eutectic (area percentage in a coating layer cross-section of the Zn—Al—$MgZn_2$ ternary eutectic) and the particle diameter (average major diameter) of the Zn—Al binary eutectic were measured by the above-described method.

The presence or absence and the degree of concentration of Ni into the outermost surface layer portion of the coating layer was evaluated by the above-described GDS analysis on the basis of the following criteria:

○: the peak of concentrated. Ni appears at nearly the same position as that of the peak of concentrated Zn, Δ: the peak of concentrated Ni appears on the side (basis material side) somewhat inner than the peak of concentrated Zn, x: the peak of concentrated Ni appears on the side (basis material side) inner than the peaks of concentrated Al and Mg.

The coating appearance and the blackening resistance were evaluated by the following evaluation methods.

(1) Coating Appearance (1-1) Foreign Matter (Dross) Adhesion

The number of foreign matters (dross) adhered to a predetermined area (70 mm×100 mm) of surface of the hot-dip Zn—Al alloy coated steel sheet was counted visually, and evaluation was performed on the basis of the following five criteria. Grade 4 or better was evaluated as "good."

Grade 5: no foreign matter adhered

Grade 4: 1 foreign matter adhered

Grade 3: 2 to 3 foreign matters adhered

Grade 2: 4 to 6 foreign matters adhered

Grade 1: 7 or more foreign matters adhered (1-2) Spangle Size

The surface spangle form of the hot-dip Zn—Al alloy coated steel sheet was photographed with a stereo microscope (magnification of 10 times). The number of spangle cores in a predetermined area (70 mm×100 mm) was counted. The spangle equivalent circle diameter (spangle size) was determined on the basis of the following equation, and evaluation was performed on the basis of the following five criteria. Grade 4 or better was evaluated as "good" in surface appearance because spangles were significantly fine in visual observation.

$$[\text{measurement area}]/[\text{the number of spangle cores}]=\pi(d/2)^2$$

where d: spangle equivalent circle diameter

π: the circular constant

Grade 5: no spangle

Grade 4: spangle size is 0.2 mm or less

Grade 3: spangle size is more than 0.2 mm, and 1.0 mm or less

Grade 2: spangle size is more than 1.0 mm, and 2.0 mm or less

Grade 1: spangle size is more than 2.0 mm (1-3) Color Tone and Gloss

The color tone of the hot-dip Zn—Al alloy coated steel sheet was observed visually and, in addition, the glossiness (60 degree specular gloss) was measured with a gloss meter. Evaluation was performed on the basis of the following five criteria. Grade 4 or better was evaluated as "good."

| Color tone | Glossiness |
|---|---|
| Grade 5: tinge of white | 100 to 200 |
| Grade 4: tinge of grayish white | 201 to 250 |
| Grade 3: tinge of gray | 251 to 300 |
| Grade 2: tinge of silver gray | 301 to 350 |
| Grade 1: tinge of silver mirror color | 351 or more |

(2) Blackening Resistance

Test pieces (50 mm×70 mm) were taken from the hot-dip Zn—Al alloy coated steel sheet, and the test pieces were mutually laminated. A test (blackening test), in which the test pieces were stood for 10 days in a wet atmosphere (relative humidity: 95% or more, temperature: 49° C.), was performed. Thereafter the L value (luminance level) of the test piece surface was measured with a color difference meter on the basis of JIS-Z-8722 specifications, and the change in L value (ΔL) between before and after the blackening test was determined. The blackening resistance was evaluated on the basis of the following five criteria. Grade 3 or better was effective, and among them, Grade 4 or better was evaluated as "good."

Grade 5: ΔL=0

Grade 4: ΔL=1 to 3

Grade 3: ΔL=4 to 8

Grade 2: ΔL=9 to 12

Grade 1: ΔL=13 or more

In Table 1 and Table 2, *1 to *5 indicate the following matters:

*1 X: Area percentage of ternary eutectic of Zn—Al—Mg intermetallic compound in the coating layer

*2 Y: Average major diameter of Zn—Al binary eutectic

*3 Symbols ○ to x indicate the evaluation described in the specification

*4 Cooling rate: Rate of cooling to 250° C. after coating

*5 Numbers indicate the grade described in the specification

TABLE 1

| No | Coating layer composition (percent by mass) Al | Mg | Ni | Co | La | Zn | Coating layer structure X (%) *1 | Y (μm) *2 | Presence or absence and degree of concentration of Ni into outermost surface layer portion of coating layer | Coating treatment condition *4 Bath temperature (° C.) | Dipping time (sec) | Cooling rate (° C./sec) | Coating appearance *5 Foreign matter adhesion | Spangle size | Color tone and gloss | Blackening resistance *6 |
|---|---|---|---|---|---|---|---|---|---|---|---|---|---|---|---|---|
| Inv. Ex. 1 | 1.0 | 0.2 | 0.05 | — | — | rest | 10 | 9 | ○ | 480 | 2 | 5 | 4 | 5 | 5 | 5 |
| Inv. Ex. 2 | 4.2 | 0.9 | 0.008 | 0.010 | 0.005 | rest | 29 | 4 | ○ | 460 | 3 | 10 | 4 | 5 | 5 | 5 |
| Inv. Ex. 3 | 4.6 | 0.8 | 0.03 | 0.015 | 0.015 | rest | 23 | 6 | ○ | 430 | 2 | 8 | 4 | 5 | 5 | 5 |
| Inv. Ex. 4 | 5.1 | 0.9 | 0.09 | — | — | rest | 20 | 6 | ○ | 475 | 2 | 12 | 4 | 5 | 4 | 6 |
| Inv. Ex. 5 | 8.0 | 0.5 | 0.05 | 0.010 | — | rest | 13 | 7 | ○ | 456 | 3 | 15 | 4 | 5 | 4 | 5 |
| Inv. Ex. 6 | 3.9 | 0.4 | 0.03 | 0.004 | 0.002 | rest | 12 | 6 | ○ | 506 | 1 | 10 | 4 | 5 | 5 | 4 |
| Inv. Ex. 7 | 7.2 | 0.6 | 0.04 | 0.008 | 0.003 | rest | 19 | 7 | ○ | 486 | 1 | 3 | 4 | 5 | 5 | 5 |
| Inv. Ex. 8 | 5.3 | 0.8 | 0.01 | 0.022 | 0.001 | rest | 24 | 3 | ○ | 430 | 2 | 10 | 4 | 5 | 4 | 6 |
| Inv. Ex. 9 | 2.9 | 0.7 | 0.03 | — | 0.040 | rest | 21 | 5 | ○ | 505 | 1 | 14 | 4 | 5 | 5 | 4 |
| Inv. Ex. 10 | 8.2 | 0.9 | 0.04 | 0.034 | 0.002 | rest | 27 | 5 | ○ | 465 | 1 | 9 | 4 | 5 | 5 | 5 |
| Inv. Ex. 11 | 5.3 | 1.0 | 0.06 | 0.008 | 0.010 | rest | 29 | 3 | ○ | 430 | 2 | 15 | 4 | 5 | 4 | 5 |
| Inv. Ex. 12 | 7.1 | 0.6 | 0.02 | 0.004 | 0.003 | rest | 17 | 8 | Δ | 500 | 2 | 30 | 4 | 4 | 4 | 3 |
| Comp. Ex. 1 | 4.5 | 0 | 0 | — | — | rest | 0 | 20 | X | 450 | 2 | 10 | 4 | 1 | 1 | 1 |
| Comp. Ex. 2 | 4.5 | 0 | 0.04 | — | — | rest | 0 | 17 | X | 480 | 2 | 15 | 4 | 1 | 1 | 1 |
| Comp. Ex. 3 | 8.0 | 0.8 | 0 | 0.010 | 0.006 | rest | 23 | 5 | X | 420 | 2 | 5 | 4 | 4 | 4 | 1 |
| Comp. Ex. 4 | 5.5 | 0.1 | 0.002 | — | — | rest | 25 | 15 | X | 470 | 2 | 10 | 4 | 2 | 3 | 2 |
| Comp. Ex. 5 | 8.5 | 5.0 | 0.006 | — | — | rest | 58 | 2 | Δ | 500 | 3 | 20 | 1 | 4 | 3 | 2 |
| Comp. Ex. 6 | 4.5 | 7.6 | 0.06 | 0.081 | 0.001 | rest | 63 | 3 | X | 490 | 2 | 5 | 1 | 4 | 3 | 1 |
| Comp. Ex. 7 | 4.2 | 2.5 | 0.05 | — | — | rest | 42 | 12 | Δ | 470 | 2 | 10 | 2 | 4 | 4 | 2 |
| Comp. Ex. 8 | 4.1 | 0.15 | 0.05 | — | — | rest | 9 | 14 | X | 496 | 2 | 10 | 4 | 2 | 3 | 3 |
| Comp. Ex. 9 | 4.1 | 0.5 | 0.16 | — | — | rest | 15 | 6 | Δ | 465 | 2 | 10 | 3 | 4 | 4 | 4 |

Inv. Ex.: Invention Example

Comp. Ex.: Comparative Example (The same goes for Table 2 to Table 4)

TABLE 2

| No | Coating layer composition (percent by mass) Al | Mg | Ni | Co | La | Zn | Coating layer structure X (%) *1 | Y (μm) *2 | Presence or absence and degree of concentration of Ni into outermost surface layer | Coating treatment condition *4 Bath temperature (° C.) | Dipping time (sec) | Cooling rate (° C./sec) | Coating appearance *5 Foreign matter adhesion | Spangle size | Color tone and gloss | Blackening resistance *5 |
|---|---|---|---|---|---|---|---|---|---|---|---|---|---|---|---|---|
| Comp. Ex. 10 | 4.3 | 0 | 0 | 0 | 0 | rest | 0 | 25 | X | 450 | 2 | 10 | 4 | 1 | 1 | 1 |
| Comp. Ex. 11 | 4.5 | 0 | 0.03 | 0 | 0 | rest | 0 | 35 | X | 480 | 2 | 16 | 4 | 1 | 1 | 1 |
| Comp. Ex. 12 | 3.7 | 0.4 | 0 | 0 | 0 | rest | 18 | 8 | X | 420 | 2 | 5 | 4 | 4 | 4 | 1 |
| Comp. Ex. 13 | 5.0 | 2.5 | 0.005 | 0 | 0 | rest | 40 | 15 | Δ | 500 | 3 | 20 | 1 | 4 | 3 | 2 |
| Comp. Ex. 14 | 4.5 | 1.5 | 0.06 | 0 | 0 | rest | 50 | 10 | ○ | 490 | 2 | 5 | 1 | 4 | 3 | 1 |
| Inv. Ex. 13 | 7.1 | 0.6 | 0.02 | 0 | 0 | rest | 10 | 20 | Δ | 500 | 2 | 25 | 4 | 4 | 4 | 3 |
| Inv. Ex. 14 | 4.2 | 0.6 | 0.008 | 0 | 0 | rest | 15 | 7 | ○ | 460 | 3 | 10 | 4 | 5 | 5 | 5 |
| Inv. Ex. 15 | 4.5 | 0.8 | 0.03 | 0 | 0 | rest | 20 | 7 | ○ | 430 | 2 | 8 | 4 | 5 | 5 | 5 |
| Inv. Ex. 16 | 6.1 | 0.7 | 0.09 | 0 | 0 | rest | 23 | 8 | ○ | 475 | 2 | 12 | 4 | 5 | 4 | 5 |
| Inv. Ex. 17 | 8.0 | 0.5 | 0.05 | 0 | 0 | rest | 18 | 4 | ○ | 455 | 3 | 15 | 4 | 5 | 4 | 5 |
| Inv. Ex. 18 | 3.9 | 0.4 | 0.03 | 0 | 0 | rest | 19 | 6 | ○ | 505 | 1 | 10 | 4 | 5 | 5 | 5 |
| Inv. Ex. 19 | 7.2 | 0.6 | 0.04 | 0 | 0 | rest | 23 | 5 | ○ | 485 | 1 | 3 | 4 | 5 | 5 | 5 |
| Inv. Ex. 20 | 5.3 | 0.8 | 0.01 | 0 | 0 | rest | 26 | 4 | ○ | 430 | 2 | 10 | 4 | 5 | 5 | 5 |
| Inv. Ex. 21 | 2.9 | 0.6 | 0.03 | 0 | 0 | rest | 12 | 8 | ○ | 505 | 1 | 14 | 4 | 5 | 5 | 5 |
| Inv. Ex. 22 | 6.2 | 0.7 | 0.04 | 0 | 0 | rest | 28 | 6 | ○ | 485 | 1 | 9 | 4 | 5 | 5 | 5 |
| Inv. Ex. 23 | 5.3 | 0.8 | 0.06 | 0 | 0 | rest | 24 | 4 | ○ | 430 | 2 | 15 | 4 | 5 | 5 | 5 |
| Inv. Ex. 24 | 4.6 | 0.7 | 0.02 | 0 | 0 | rest | 20 | 7 | ○ | 440 | 2 | 8 | 4 | 5 | 5 | 5 |
| Inv. Ex. 25 | 4.5 | 0.6 | 0.02 | 0 | 0 | rest | 22 | 7 | ○ | 440 | 2 | 9 | 4 | 5 | 5 | 5 |

The hot-dip Zn—Al alloy coated steel sheet produced as described above was subjected to a chemical conversion treatment, and application of a primer was performed, if necessary. Subsequently, topcoat (resin) was applied so as to produce a resin-coated steel sheet. Regarding the resulting resin-coated steel sheet, the painting appearance, the painting film adhesion (Erichsen cupping), bending workability (1T bending), and the like were evaluated.

In the production of the resin-coated steel sheet, there are relatively few cases in which the chemical conversion treatment is performed just after the coating. Therefore, separately from the steel sheet produced by performing the chemical conversion treatment, the application of the primer, and the application of the topcoat (resin) just after the coating, a few tens of samples cut after the coating were laminated, packed and, subsequently, stood for 60 days in a coil shed of an indoor coating line until the chemical conversion treatment was performed. Regarding the resulting steel sheet, the state of occurrence of blackening and the like of the coating surface were examined, and the chemical conversion treatment, the application of the primer, and the application of the topcoat (resin) were performed. For the treatment agent of the chemical conversion treatment, "ZM3360H" (trade name, produced by Nihon Parkerizing Co., Ltd.) was used in the chromate treatment, and "CT-E320" (trade name, produced by Nihon Parkerizing Co., Ltd.) was used in the chromium-free treatment. For the primer, "JT250" (trade name, produced by NIPPON FINE COATINGS, Inc.), which was an epoxy paint, was used. For the polyester topcoat paint, "KP1500" (trade name, produced by Kansai Paint Co., Ltd.) was used, and for fluororesin topcoat, "Precolor NO 8800" (trade name, produced by BASF Japan Ltd.) was used.

Table 3 and Table 4 show the appearance after painting, the painting film adhesion, and the bending workability of each product and the blackening resistance of the sample stood for 60 days before the chemical conversion treatment, as well as each type of the chemical-conversion-treated layer, the primer layer, and the topcoat (resin) layer.

Regarding the blackening resistance of the test piece stood for 60 days before the chemical conversion treatment, the L value (luminance level) of the test piece surface was measured with a color difference meter on the basis of JIS-Z-8722 specifications. The change in L value (ΔL) between before and after the standing was determined, and evaluation was performed on the basis of the five criteria as in the above-described "(2) Blackening resistance."

The appearance after painting, the painting film adhesion, and the bending workability were evaluated by the following evaluation methods.

(3) Appearance After Painting

The surface of the resin-coated steel sheet was observed visually, and evaluation was performed on the basis of the following three criteria:

Grade 3: there is no lack of hiding of spangle pattern

Grade 2: there is a little lack of hiding of spangle pattern

Grade 1: there is lack of hiding of spangle pattern (4) Painting Film Adhesion

The test piece surface of the resin-coated steel sheet was cut to have 100 pieces of cross-cut (squares), an adhesive tape was adhered and peeled off, and evaluation was performed on the basis of the number of peeled squares, as described in the following five criteria:

Grade 5: no peeling

Grade 4: the number of peeled squares is 1 to 5 pieces

Grade 3: the number of peeled squares is 6 to 15 pieces

Grade 2: the number of peeled squares is 16 to 35 pieces

Grade 1: the number of peeled squares is 36 pieces or more (5) Bending Workability The test piece of the resin-coated steel sheet was subjected to 1T bonding (180-degree-bending was performed in such a way as to sandwich one tabular sheet having the same thickness as that of the test piece) and, thereafter an adhesive tape was adhered and peeled off. The state of the painting was observed, and evaluation was performed on the basis of the following five criteria:

Grade 5: almost no cracking occurred, and no peeling occurred

Grade 4: cracking occurred slightly, and no peeling occurred

Grade 3: cracking occurred frequently, and peeling occurred in a part of the sample (area percentage of less than 10%)

Grade 2: area percentage of peeling of 11% to 50%

Grade 1: area percentage of peeling of 51% or more

In Table 3 and Table 4, *1 indicates the following matter:

*1 Numbers indicate the grade described in the specification

TABLE 3

| No | Presence or absence of indoor standing (for 60 days) in lamination state | Blackening resistance *1 | Type of chemical conversion treatment | Primer layer: Type of resin | Primer layer: Film thickness (m) | Resin layer: Type of paint | Resin layer: Film thickness (m) | Topcoat application method | Appearance after painting *1 | Painting adhesion *1 | Bending workability *1 |
|---|---|---|---|---|---|---|---|---|---|---|---|
| Inv. Ex. 1 | presence | 5 | chromium free | epoxy | 5 | polyester | 20 | roll coater | 3 | 5 | 5 |
| Inv. Ex. 2 | presence | 3 | chromium free | epoxy | 5 | polyester | 16 | roll coater | 3 | 4 | 4 |
| Inv. Ex. 3 | presence | 5 | chromate | epoxy | 10 | polyester | 20 | roll coater | 3 | 5 | 5 |
| Inv. Ex. 4 | presence | 4 | chromate | epoxy | 10 | polyester | 20 | roll coater | 3 | 5 | 5 |
| Inv. Ex. 5 | presence | 5 | chromium free | epoxy | 5 | polyester | 20 | roll coater | 3 | 5 | 5 |
| Inv. Ex. 6 | presence | 5 | chromium free | epoxy | 5 | polyester | 20 | roll coater | 3 | 5 | 5 |
| Inv. Ex. 7 | presence | 5 | chromium free | epoxy | 5 | polyester | 20 | roll coater | 3 | 5 | 5 |
| Inv. Ex. 8 | presence | 4 | chromium free | epoxy | 10 | polyester | 20 | roll coater | 3 | 5 | 5 |
| Inv. Ex. 9 | presence | 5 | chromate | epoxy | 10 | fluororesin | 25 | roll coater | 3 | 5 | 5 |
| Inv. Ex. 10 | presence | 4 | chromate | epoxy | 5 | polyester | 20 | spraying | 3 | 5 | 5 |
| Inv. Ex. 11 | presence | 5 | chromium free | epoxy | 15 | polyester | 20 | roll coater | 3 | 5 | 5 |
| Inv. Ex. 12 | presence | 5 | chromium free | epoxy | 10 | fluororesin | 15 | spraying | 3 | 5 | 5 |
| Comp. Ex. 1 | absence | — | chromate | epoxy | 10 | polyester | 20 | roll coater | 1 | 4 | 4 |
| | presence | 2 | | | | | | | 1 | 5 | 2 |
| Comp. Ex. 2 | presence | 4 | chromium free | epoxy | 10 | polyester | 20 | roll coater | 1 | 3 | 3 |
| Comp. Ex. 3 | presence | 1 | chromium free | epoxy | 5 | polyester | 20 | roll coater | 3 | 1 | 2 |
| Comp. Ex. 4 | absence | — | chromate | epoxy | 15 | fluororesin | 20 | roll coater | 3 | 4 | 4 |
| | presence | 2 | | | | | | | 3 | 2 | 2 |
| Comp. Ex. 5 | presence | 1 | chromium free | epoxy | 10 | fluororesin | 25 | roll coater | 3 | 1 | 2 |
| Comp. Ex. 6 | presence | 1 | chromium free | epoxy | 5 | polyester | 25 | roll coater | 3 | 1 | 1 |
| Comp. Ex. 7 | presence | 2 | chromate | epoxy | 5 | polyester | 25 | roll coater | 3 | 1 | 1 |
| Comp. Ex. 8 | absence | — | chromate | epoxy | 10 | polyester | 20 | roll coater | 2 | 5 | 5 |
| | presence | 3 | | | | | | | 2 | 3 | 4 |
| Comp. Ex. 9 | absence | — | chromium free | epoxy | 5 | fluororesin | 30 | spraying | 3 | 5 | 5 |
| | presence | 5 | | | | | | | 3 | 3 | 3 |

TABLE 4

| No | Presence or absence of indoor standing (for 60 days) in lamination state | Blackening resistance *1 | Type of chemical conversion treatment | Primer layer: Type of resin | Primer layer: Film thickness (m) | Resin layer: Type of paint | Resin layer: Film thickness (m) | Topcoat application method | Appearance after painting *1 | Painting adhesion *1 | Bending workability *1 |
|---|---|---|---|---|---|---|---|---|---|---|---|
| Comp. Ex. 10 | absence | — | chromate | epoxy | 5 | polyester | 15 | roll coater | 2 | 4 | 4 |
| | presence | 1 | | | | | | | 2 | 2 | 2 |
| Comp. Ex. 11 | absence | — | chromium free | epoxy | 5 | polyester | 20 | roll coater | 1 | 5 | 5 |
| Comp. Ex. 12 | absence | — | chromium free | epoxy | 10 | polyester | 20 | roll coater | 3 | 4 | 4 |
| | presence | 1 | | | | | | | 3 | 1 | 1 |
| Comp. Ex. 13 | absence | — | chromium free | epoxy | 10 | polyester | 15 | roll coater | 3 | 4 | 4 |
| | presence | 2 | | | | | | | 3 | 2 | 2 |
| Comp. Ex. 14 | absence | — | chromate | epoxy | 5 | polyester | 20 | spraying | 3 | 5 | 5 |
| | presence | 2 | | | | | | | 3 | 2 | 2 |
| Inv. Ex. 13 | absence | — | chromate | epoxy | 5 | polyester | 25 | roll coater | 3 | 4 | 4 |
| | presence | 3 | | | | | | | 3 | 3 | 3 |
| Inv. Ex. 14 | presence | 4 | chromium free | epoxy | 5 | polyester | 20 | roll coater | 3 | 4 | 4 |
| Inv. Ex. 15 | presence | 5 | chromate | epoxy | 8 | fluororesin | 15 | spraying | 3 | 5 | 5 |
| Inv. Ex. 16 | absence | — | chromate | epoxy | 10 | polyester | 16 | roll coater | 3 | 5 | 5 |
| | presence | 5 | | | | | | | 3 | 5 | 5 |
| Inv. Ex. 17 | presence | 5 | chromium free | epoxy | 5 | fluororesin | 25 | roll coater | 3 | 5 | 5 |
| Inv. Ex. 18 | presence | 5 | chromium free | epoxy | 15 | polyester | 18 | roll coater | 3 | 5 | 5 |
| Inv. Ex. 19 | presence | 5 | chromium free | epoxy | 10 | polyester | 20 | spraying | 3 | 5 | 5 |
| Inv. Ex. 20 | absence | — | chromate | epoxy | 7 | polyester | 20 | roll coater | 3 | 5 | 5 |
| | presence | 4 | | | | | | | 3 | 4 | 4 |
| Inv. Ex. 21 | presence | 5 | chromate | | 5 | fluororesin | 25 | roll coater | 3 | 5 | 5 |

TABLE 4-continued

| No | Presence or absence of indoor standing (for 60 days) in lamination state | Blackening resistance *1 | Type of chemical conversion treatment | Primer layer: Type of resin | Primer layer: Film thickness (m) | Resin layer: Type of paint | Resin layer: Film thickness (m) | Topcoat application method | Appearance after painting *1 | Painting adhesion *1 | Bending workability *1 |
|---|---|---|---|---|---|---|---|---|---|---|---|
| Inv. Ex. 22 | presence | 5 | chromium free | epoxy | 5 | fluororesin | 30 | roll coater | 3 | 5 | 5 |
| Inv. Ex. 23 | absence | — | chromium free | epoxy | 8 | polyester | 15 | spraying | 3 | 5 | 5 |
| | presence | 5 | | | | | | | 3 | 5 | 5 |
| Inv. Ex. 24 | presence | 5 | chromate | — | 0 | polyester | 15 | roll coater | 3 | 5 | 5 |
| Inv. Ex. 25 | presence | 5 | chromium free | — | 0 | fluororesin | 20 | roll coater | 3 | 5 | 5 |

What is claimed is:

1. A hot-dip Zn—Al alloy coated steel sheet comprising a hot-dip Zn—Al alloy GF coating layer consisting essentially of 1.0 to 10 percent by mass of Al, 0.2 to 1.0 percent by mass of Mg, 0.005 to 0.1 percent by mass of Ni, 0.05 percent by mass or less of Ce, 0.05 percent by mass or less of La, and the balance being Zn and incidental impurities on at least one surface of a steel sheet, wherein the hot-dip Zn—Al alloy coating layer comprises binary Zn—Al with eutectic composition and ternary Al—Zn—Mg intermetallic compound with eutectic composition.

2. The hot-dip Zn—Al alloy coated steel sheet according to claim 1, wherein the Ni is concentrated in an outermost surface layer portion of the hot-dip Zn—Al alloy coating layer.

3. A hot-dip Zn—Al alloy coated steel sheet comprising a hot-dip Zn—Al alloy GF coating layer containing 1.0 to 10 percent by mass of Al, 0.2 to 1.0 percent by mass of Mg, 0.005 to 0.1 percent by mass of Ni, 0.05 percent by mass or less of Ce, 0.05 percent by mass or less of La, and the balance being Zn and incidental impurities on at least one surface of a steel sheet, wherein the hot-dip Zn—Al alloy coating layer comprises binary Zn—Al with eutectic composition and ternary Al—Zn—Mg intermetallic compound with eutectic composition.

4. The hot-dip Zn—Al alloy coated steel sheet according to claim 3, wherein the Ni is concentrated in an outermost surface layer portion of the hot-dip Zn—Al alloy coating layer.

* * * * *

UNITED STATES PATENT AND TRADEMARK OFFICE

CERTIFICATE OF CORRECTION

PATENT NO. : 8,962,153 B2
APPLICATION NO. : 12/441604
DATED : February 24, 2015
INVENTOR(S) : Koumura et al.

It is certified that error appears in the above-identified patent and that said Letters Patent is hereby corrected as shown below:

In the specification

In Column 13

At Table 1, column 4, at the subheading Ni, at row 17, please change "0.006" to --0.005--, and at row 21, please change "0.16" to --0.15--; at column 9, at the subheading *2, at rows 3 and 4, please change "6" to --5--, and at row 12, please change "8" to --6--; at column 11, at the subheading (° C.), at row 5, please change "456" to --455--, at row 6, please change "506" to --505--, at row 7, please change "486" to --485--, at row 10, please change "465" to --485--, and at row 20, please change "496" to --495--.

At Table 4-continued, column 6, at the subheading Film thickness (m), at row 2, please change "8" to --9--.

Signed and Sealed this
Thirteenth Day of October, 2015

Michelle K. Lee

Michelle K. Lee
*Director of the United States Patent and Trademark Office*